US008485233B2

(12) United States Patent
Allinson et al.

(10) Patent No.: US 8,485,233 B2
(45) Date of Patent: Jul. 16, 2013

(54) BIO-FUELS VEHICLE FUELING SYSTEM

(75) Inventors: Paul Anthony Allinson, Danville, CA (US); Curtis Lee Munson, Oakland, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1199 days.

(21) Appl. No.: 11/937,360

(22) Filed: Nov. 8, 2007

(65) Prior Publication Data

US 2011/0000579 A1 Jan. 6, 2011

(51) Int. Cl.
*B65B 3/04* (2006.01)

(52) U.S. Cl.
USPC ..... 141/104; 141/105

(58) Field of Classification Search
USPC ..... 700/241; 141/100, 104, 105, 107, 141/234, 285, 301, 302
See application file for complete search history.

(56) References Cited

U.S. PATENT DOCUMENTS

| | | | | |
|---|---|---|---|---|
| 5,163,586 | A * | 11/1992 | Zinsmeyer | 222/14 |
| 5,311,852 | A * | 5/1994 | Yoshida et al. | 123/674 |
| 6,032,703 | A | 3/2000 | Baker et al. | |
| 6,065,638 | A * | 5/2000 | Terranova et al. | 222/1 |
| 6,112,134 | A | 8/2000 | Terranova et al. | |
| 6,161,060 | A | 12/2000 | Collins | |
| 6,163,738 | A | 12/2000 | Miller | |
| 6,341,629 | B1 | 1/2002 | Clark et al. | |
| 7,072,839 | B2 | 7/2006 | Willner et al. | |
| 7,913,664 | B2 * | 3/2011 | Williams et al. | 123/304 |
| 2005/0055874 | A1 * | 3/2005 | Bekemeyer | 44/629 |
| 2007/0021865 | A1 | 1/2007 | Albertson | |
| 2007/0144605 | A1 | 6/2007 | Horowitz et al. | |
| 2007/0152155 | A1 | 7/2007 | Chu et al. | |
| 2009/0005903 | A1 * | 1/2009 | Winsness | 700/239 |
| 2010/0263266 | A1 * | 10/2010 | Nelson, Jr. | 44/451 |

FOREIGN PATENT DOCUMENTS

WO WO 96/15064 5/1996

OTHER PUBLICATIONS

Australian Search Report dated Jun. 14, 2012, for Application No. 2008325002.

* cited by examiner

*Primary Examiner* — Jason K Niesz
(74) *Attorney, Agent, or Firm* — Josetta I. Jones; Morgan, Lewis & Bockius; Brett Lovejoy

(57) ABSTRACT

A system for custom fueling a motor vehicle including: a fuel dispenser configured and adapted to blend fuels from two or more tanks while dispensing; a processor in communication with the fuel dispenser and configured and adapted to receive a set of fuel blend information for a motor vehicle, wherein the set of fuel blend information includes in-warranty bio-diesel blend ranges and customer fuel blend preferences; a fuel blend selection module operably connected to the processor for receiving the set of fuel blend information, processing the set of fuel blend information, and returning fuel blend instructions which are then provided to the fuel dispenser for dispensing fuel per the fuel blend instructions.

27 Claims, 2 Drawing Sheets

BIO-FUELS VEHICLE FUELING SYSTEM

COPYRIGHT NOTICE AND AUTHORIZATION

This patent document contains material which is subject to copyright protection.

© Copyright 2007. Chevron U.S.A. Inc. All rights reserved.

With respect to this material which is subject to copyright protection. The owner, Chevron U.S.A. Inc., has no objection to the facsimile reproduction by any one of the patent disclosure, as it appears in the Patent and Trademark Office patent files or records of any country, but otherwise reserves all rights whatsoever.

FIELD OF THE INVENTION

The invention relates to process and system for fueling of biofuel-capable motor vehicles.

BACKGROUND OF THE INVENTION

Government mandate, environmental concerns and rising fuel costs have prompted engine companies to develop engines and ground transportation vehicles with improved mileage and reduced emissions. Improved engine concepts include use of higher compression ratio, low-temperature combustion systems, such as HCCI, PCCI and the like dual fuel concepts, fuel cell electric vehicles that utilize on-board reforming and a variety of hybrids including plug-in electric hybrids.

Many of these new engine types are likely to run on currently and widely available fuels. However it is likely that the optimal fuel is different in composition than the fuels available today. Some new engines, in-fact, may require the use of new fuel formulations.

New engines will, however, replace current conventional engines at a limited rate as new cars are introduced and old models removed from service. It is necessary to create a fueling station that has the flexibility to provide both new formulations as well as more conventional fuels. In addition, these same environmental and cost concerns have resulted in increased development and availability of fuels from renewable resources.

These fuels include ethanol and bio-diesel. Biodiesel generally refers to fatty acid methyl ester (FAME), where the fatty acid is derived from vegetable oils or animal fats. Because of the range of possible feedstocks, FAME biodiesels are not all the same but can have a range of physical properties. FAME biodiesel is generally used as a blend with petroleum-derived diesel. Engine manufacturers, however, do not necessarily warranty their engines over the entire range of biodiesel blends. Nor do all manufacturers set the same upper limit for biodiesel blends in their engine warranties. It is necessary to limit the amount of biodiesel blend in order to keep the engine in warranty. Furthermore, FAME biodiesels often have higher freezing points and viscosity than petroleum-derived diesel. For this reason the maximum amount of biodiesel blended with petroleum-derived diesel can also vary with the seasonal temperatures.

Ethanol in a similar fashion is generally used as a blend with petroleum-derived gasoline. The highest common level of blend, so called E85, is 85% ethanol. More commonly used concentration ranges of 3-10% are often set by mandate. Not all automobiles, however, are able to run over this entire concentration range. Again, it is necessary to limit the upper level of ethanol in the gasoline formulation.

At the same time, customers will have a range of preferences for their fuel characteristics. Customers have different sensitivities to cost, performance and the environmental impact. Some consumers will want to use the maximum percent of renewable fuel comment within warrantee, while others will prefer less.

It would be desirable to have a bio-fuels fueling system which assured that fuels used in the motor vehicle are within the manufacturer's specified range for warranty compliance. The instant invention provides such a solution.

SUMMARY OF THE INVENTION

This invention enables a fueling station to flexibly provide the optimal fuel for the new and advanced combustion engine, while at the same time retaining the ability to provide, fuel for today's conventional internal combustion engines. The station will also be able to factor in customer preferences to the maximum practical extent.

The proposed invention in one embodiment is a system for custom fueling a motor vehicle including: a fuel dispenser configured and adapted to blend fuels from two or more tanks while dispensing; a processor in communication with the fuel dispenser and configured and adapted to receive a set of fuel blend information for a motor vehicle, wherein the set of fuel blend information includes information sufficient to determine in-warranty bio-diesel blend ranges and customer fuel blend preferences; a fuel blend selection module operably connected to the processor for receiving the set of fuel blend information, processing the set of fuel blend information, and returning fuel blend instructions which are then provided to the fuel dispenser for dispensing fuel per the fuel blend instructions.

Another embodiment of the invention includes a method for a method for custom fueling a motor vehicle including: inputting a set of fuel blend information for a motor vehicle to a processor; wherein the processor is in communication with a fuel dispenser configured and adapted to blend fuels from two or more tanks while dispensing, wherein the set of fuel blend information includes in-warranty bio-diesel blend ranges and customer fuel blend preferences, and wherein the processor is communication with a fuel blend selection module operably connected to the processor and configured and adapted for receiving the set of fuel blend information, processing the set of fuel blend information, and returning fuel blend instructions which are then provided to the fuel dispenser for dispensing fuel per the fuel blend instructions; passing the set of fuel blend information to the fuel blend selection module, whereby fuel blend instructions are returned; and passing the fuel blend instructions to the fuel dispenser for dispensing of fuel according to the fuel blend instructions.

DETAILED DESCRIPTION OF THE DRAWINGS AND PREFERRED EMBODIMENTS

A. Introduction

The following discussion and figures include a general description of a suitable computing environment in which the invention may be implemented. While the invention will be described in the general context of a system and an application program that runs on an operating system in conjunction with general purpose computers, an internet, and web, application, and email servers and clients, those skilled in the art will recognize that the invention also may be implemented in combination with other program modules. Generally, program modules include routines, programs, components, data structures, etc. that performs particular tasks or implement particular abstract data types.

Moreover, those skilled in the art will appreciate that the invention may be practiced with other computer system configurations, including hand-held devices, multiprocessor systems, microprocessor-based or programmable consumer electronics, minicomputers/servers, workstations, mainframe computers, and the like.

The invention may also be practiced in distributed computing environments where tasks are performed by remote processing devices that are linked through a communications network. In a distributed computing environment, program modules may be located in both local and remote memory storage devices.

Then invention generally relates to a custom fuel blending system for motor vehicles. The process aspects of the invention are a series of process steps utilizing, in whole or in part, the system herein and variations thereof. As would be clear to one skilled in the art, at least some of the process steps can be embodied in part as code for a computer program for operation on a conventional programmed digital computer, such as a client and server, or on another type of computing device, e.g., programmable logic controller or an application-specific integrated circuit. The program code can be embodied as a computer program on a computer-readable storage medium or as a computer data signal in a carrier wave transmitted over a network.

B. Detailed Description

Figure 1:
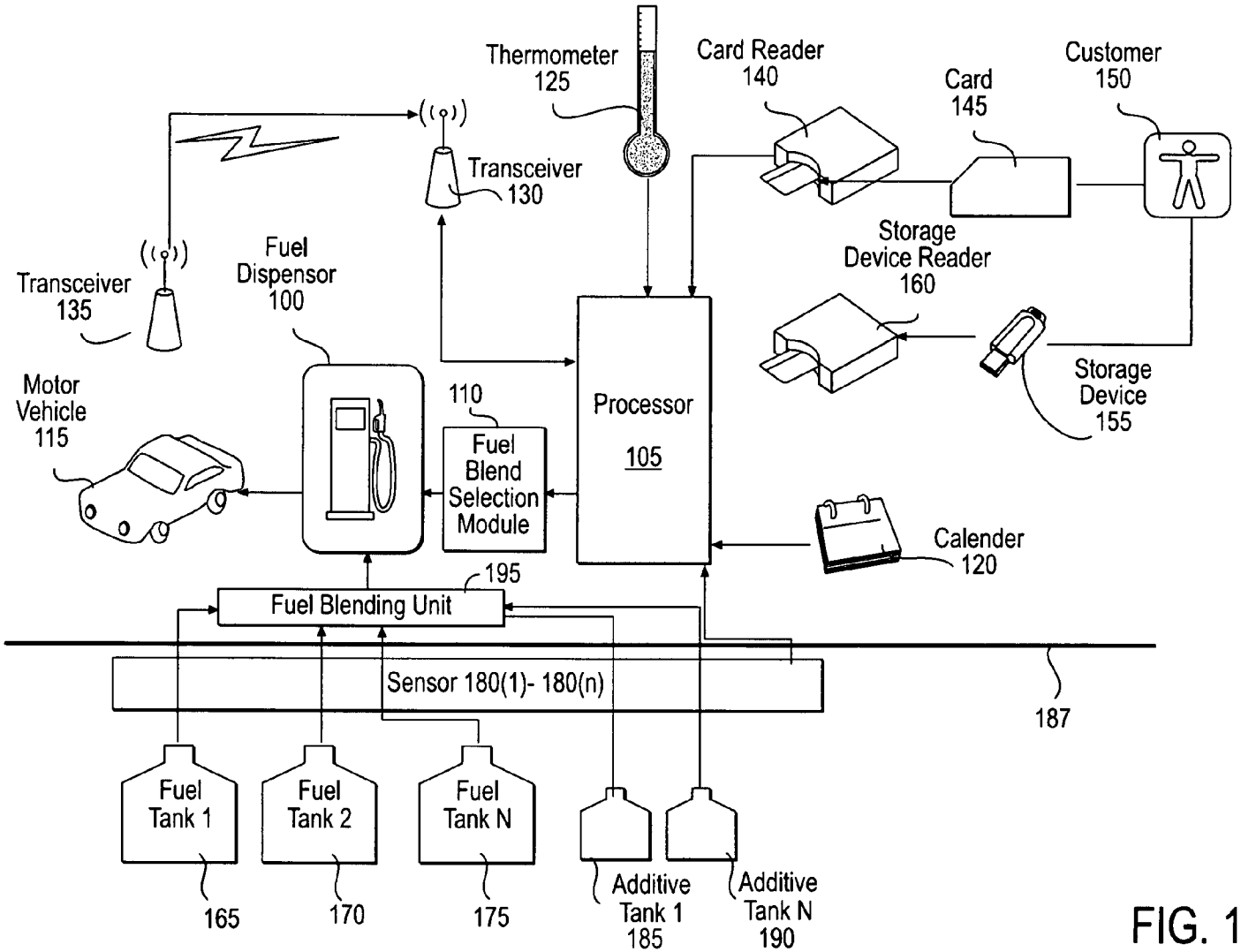
FIG. 1 depicts in one embodiment a schematic system diagram of the invention.

FIG. 1 depicts in one embodiment a schematic system diagram of the invention. The embodiment is shown in the context of a typical retail fueling station have a grade level 187. Fuel tanks 1-N (165, 170, 175), and optional additive tanks 1-N (185, 190), are typically installed below grade 187. A customer 150 will park his/her motor vehicle 115 along side Fuel Dispenser 100. Fuel Dispenser 100 is either operably connected to, or has an integral component, Fuel Blending Unit 195 for pumping from two or more Fuel Tanks (165, 170, 175) or Additive Tanks (185, 190) per instructions to create a fuel/additive blend.

Processor 105 is configured to receive data for processing by Fuel Blend Selection Module 110. The data received by Processor 105 is the data relating to the specific Motor Vehicle 115 and Customer 150 sufficient to determine fuel blend instructions for one or more fuel blends within warranty ranges of the manufacturer of Motor Vehicle 115, and optionally, within the preferences of Customer 150. Several sensor or input devices are utilized for inputting the required data to Processor 105. The primary data needed is data regarding Motor Vehicle 115. The data may be input is a wide variety of forms and formats but is sufficient for the Fuel Blend Selection Module 110 to determine those fuel blends which are within warranty of the manufacturer of Motor Vehicle 115. Preferably, there is standardized format accepted and used by all motor vehicle manufacturers which code can be used to look up the needed data, e.g., manufacturer, model, year, engine type, and acceptable fuel blends. Alternatively, the code could simply be used to look up acceptable fuel blends. Absent such a standardized code, each vehicle manufacturer may use a separate coding system. In this case, both the code and a motor vehicle manufacturer identifier would be needed. Absent use of codes, the data provided should at least include an engine type identifier and a motor vehicle manufacturer identifier. Preferably, the data also included a model identifier and year identifier if needed to determine the in-warranty fuel blends that are acceptable.

This motor vehicle data, and any other data to be input, can be input to Processor 105 via any known data transfer methodology and any unknown methods to be developed in the future. Specific preferred embodiments for inputting Motor Vehicle 115 data include having a wireless transmitter/transceiver 135 integral with or operably connected to Motor Vehicle 115. Transceiver 135 establishes a connection with and transmits needed vehicle data via any known or later developed protocol to Receiver/Transceiver 130 which is operably connected to Processor 105.

Alternately, the needed motor vehicle data could be stored on any known or later developed portable memory device 155 such as a flash drive, portable disk drive, or magnetically encoded card 145. The data on such portable memory device could be read by an appropriate, compatible reading device such as Card Reader 140 or generic Storage Device Reader 160. Customer 150 inserts the portable memory device into the compatible reader.

Additional, optionally preferable data for input to the Processor 105 includes ambient temperature data from any known or future developed temperature reading device 125 and current date from any known or future developed calendar tracking device 120.

Processor 105 passes all input data to Fuel Blend Selection Module 110 which uses such data to determine and return one or more in-warranty fuel blends for Motor Vehicle 115. The process logic for such determination is by any known or future developed process, algorithm, or mechanism. One preferred embodiment, where a standard code, for vehicle information is provided, is to utilize a lookup table where each standard code correlates with one or more in-warranty fuel blends. Where there is no standard code but a code unique to each manufacturer, the manufacturer identifier and code correlates with one or more in-warranty fuel blends. In-warranty fuel blend information is optionally obtained, e.g., directly from vehicle manufacturers or warranty booklets and operating manuals.

Where no standard codes or manufacture specific codes are used, the manufacturer identifier, model identifier, engine identifier, and any other needed data, e.g., date manufactured, correlates to one or more in-warranty fuel blends. Where more than two identifiers are used, the means for correlation with one or more in-warranty fuel blends can be via any known or future developed data structure or compatible search algorithms. For example, a multi-tree data structure could be used where the first level of nodes from the root node matches different vehicle manufacturer identifiers. Branches from those nodes then lead to model-type nodes, which leads to engine-type nodes, which leads to ambient temperature band nodes, which leads to date range nodes, ad eventually leading to the leaf nodes of the tree structure which contain one or more in-warranty fuel blends. Optionally, Customer 150 enters data manually by use of, e.g., a touch screen operably connected to or integral with the Fuel Blend Selection Module 110 and/or Fuel Dispenser 100. The manual entry of data optionally allows Customer 150 to traverse the multi-tree or other data structure to determine the in-warranty fuel blends.

The fuel blends contained in the data structure, whether lookup table, multi-tree, or other data structure, may be expressed in any known or future developed way. Preferred embodiments include where each Fuel Tank (165, 170, 175) and Additive Tank (185, 190) have an identifier and each fuel blend comprises each such Fuel Tank and Additive Tank identifier and an assigned value, e.g., indicating a percentage, where the sum of each assigned value equals 1 (or 100% depending if the value is a float/fraction totaling 1 or an integer totaling 100). Thus, the one or more fuel blends returned from the Fuel Blend Selection Module 195, in one embodiment is expressed as "aA, bB, cC, dD, eE" where the capital letters are Tank identifiers and the small letters are assigned value (assuming five tanks). Alternatively, the fuel blend could be expressed as a code which code can be decoded into Tank identifiers and assigned values by the Fuel Blending Unit 195.

In either case, after determining the one or more in-warranty fuel blends, the Fuel Blend Selection Module 110 returns them to the Fuel Blending Unit 195 and/or Fuel Dispenser 100 (depending if Fuel Blending Unit 195 is integral with or only connected to Fuel Dispenser 100). Optionally, the in-warranty fuel blend instructions are passed via the Processor.

Preferably data input to the processor also includes sensor-derived data of chemical content or properties of the fuel and additives in Fuel Tanks (165, 170, 175) and/or Additive Tanks (185, 190). Sensors (180(1-*n*)) are optionally placed above or below grade 187. They are placed and configured to be able to obtain samples of the contents of Fuel Tanks and/or Additive Tanks. This sampling optionally occurs while the tank is being filled, after the tank is being filled, or while the tank is being drawn from.

Types of sensors and the data collected/determined for input to the processor includes, e.g., sensor for determining fuel quality and composition (optionally measured on/in line). For example, small on-line near IR ("NIR") sensors may be used to estimate octane numbers for gasoline. Similarly, NIR sensors can be used to gauge the value of cetane number for diesel fuel, and also to determine the nature of bio-diesel by quantifying the oxygen content (thus giving the molecular weight of the base carbon for a FAME diesel), and the number of double bonds. Knowing the chemical makeup of the biodiesel, the Fuel Blend Selection Module 110 will know the temperature dependent characteristics, and the combustion/fuel characteristics and be able to make adjustments for a specific engine type.

Conventional on-line sensors (i.e., "on-line" meaning operably connected to the conduit carrying the fluid to be tested) may be used for such properties as density, these devices include in-line vibratory cells, or devices based on the physical law of attenuation of gamma radiation. MEMs-based microsensors will also be used that are capable of measuring key fuel properties directly including density and specific molecule concentration, such as ethanol concentration is gasoline, or detect the signature of other specific chemical components.

Exemplary types of fuels in Fuel Tanks (165, 170, 175) include, e.g., gasoline, diesel, one or more types of bio-fuel, e.g., ethanol-containing fuel.

Exemplary types of additives in Additive Tanks (185, 190) include Techron® available from Chevron Corporation and generally include additives designed, e.g., to clean or prevent engine deposits, clean fuel injectors, or otherwise enhance engine maintenance or performance.

Where more than one in-warranty fuel blend is returned from the Fuel Blend Selection Module 110, a mechanism for selecting just one blend is needed. Any suitable known or future developed mechanism for such selection is within the scope of the invention. Preferred embodiments include a default assigned, e.g., to select the fuel blend with (1) the largest percentage of bio-fuels, or (2) the lowest percentage of bio-fuels; or (3) with the lowest percentage of the fuel from a Fuel Tank having the lowest level. Alternatively, the selection is made by the Customer 150, e.g., via a touch screen (not shown). In another preferred embodiment, customer preference data is input to the Processor 105. This preference data indicates the customer's preferred default, e.g., the fuel blend with the most or least bio-fuels or the fuel blend yielding the lowest per unit cost to the Customer 150. Any known or future developed means for inputting the customer preference data to Processor 105 is within the scope of the invention. These include incorporating such customer preference data in any stored memory device 155 used to also transfer the Motor Vehicle data, encoded into Transceiver 135, or linked to a Customer identifier, e.g., a customer code encoded on a magnetic card, or linked to a credit/debit card associated with customer. Where a customer identifier is used, the customer preferences will be stored within a memory or storage device operably connected to or in communication with the Processor 105 and/or Fuel Blend Selection Module 110.

Figure 2:
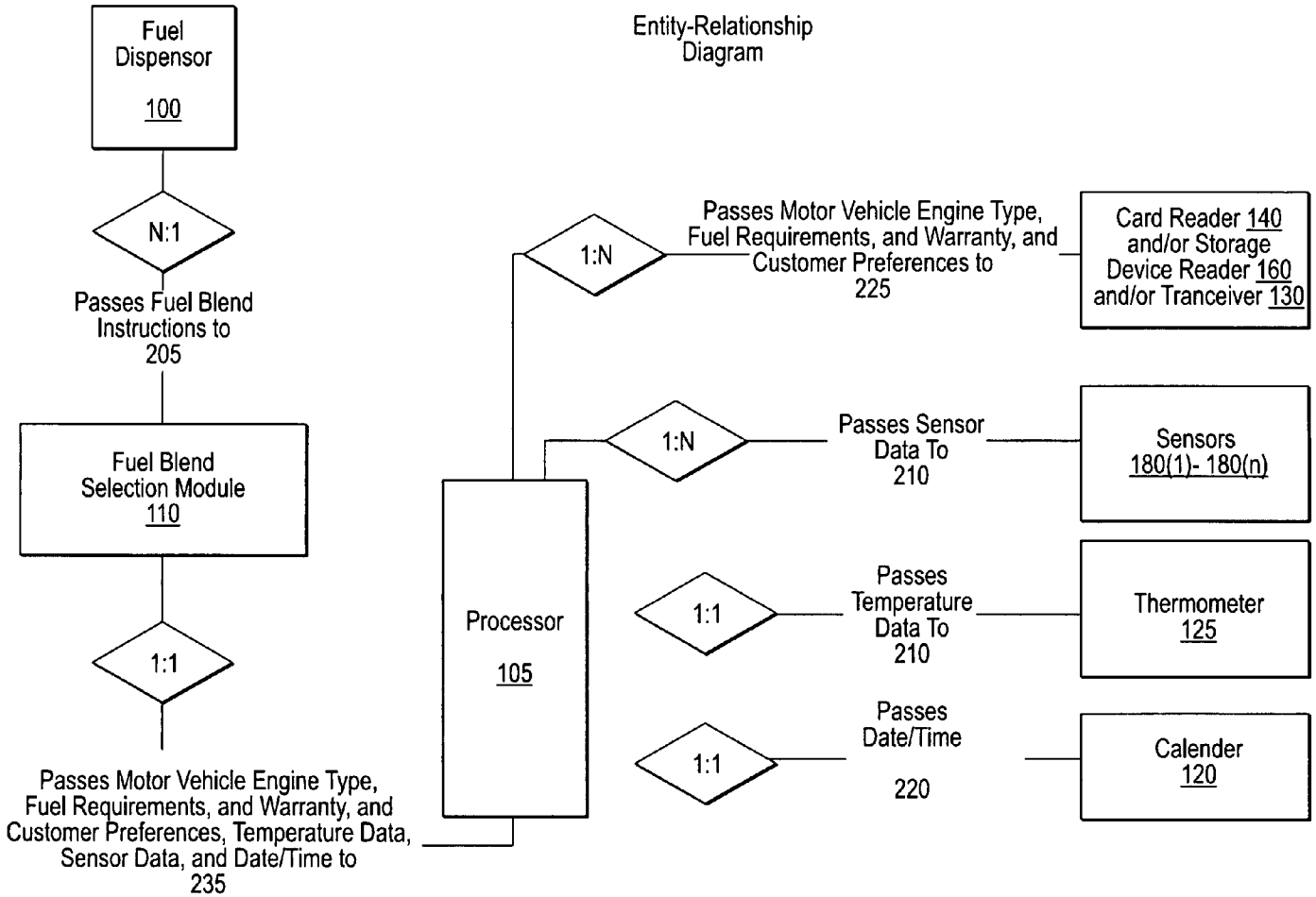
FIG. 2 depicts in one embodiment a schematic entity-relationship diagram of the invention.

FIG. 2 depicts in one embodiment a schematic entity-relationship diagram of the invention. Processor 105 has a one-to-many relationships with Card/Storage Device Reader 140/130 and receives information sufficient to determine in-warranty fuel requirements, e.g., Motor Vehicle Engine Type, Fuel Requirements, and optionally warranty information, and optionally Customer preferences. Processor 105 has a one-to-many relationships with Sensors 180(1)-(*n*) and receives sensor data from such sensors. Processor 105 has a one-to-one relationship with Temperature sensing device (e.g., thermometer) 125 and receives temperature data from it or data that can be converted to temperature data. Processor 105 has a one-to-one relationship with calendar device 120 and receives date data or season data or information that can be converted to date or season data. Processor 105 has a one-to-one relationship with Fuel Blend Selection Module 110 and passes to it all data/information collected from the above-described input entities. Fuel Blend Selection Module 110 optionally has a one-to-many relationships with Fuel Dispenser 100 in that a single Fuel Blend Selection Module may support multiple Fuel Dispensers.

C. Other Implementation Details

1. Terms

The detailed description contained herein is represented partly in terms of processes and symbolic representations of operations by a conventional computer and/or wired or wireless network. The processes and operations performed by the computer include the manipulation of signals by a processor and the maintenance of these signals within data packets and data structures resident in one or more media within memory storage devices. Generally, a "data structure" is an organizational scheme applied to data or an object so that specific operations can be, performed upon that data or modules of data so that specific relationships are, established between organized parts of the data structure.

A "data packet" is type of data structure having one or more related fields, which are collectively defined as a unit of information transmitted from one device or program module to another. Thus, the symbolic representations of operations are the means used by those skilled in the art of computer programming and computer construction to most effectively convey teachings and discoveries to others skilled in the art.

For the purposes of this discussion, a process is generally conceived to be a sequence of computer-executed steps leading to a desired result. These steps generally require physical manipulations of physical quantities. Usually, though not necessarily, these quantities take the form of electrical, magnetic, or optical signals capable of being stored, transferred, combined, compared, or otherwise manipulated. It is conventional for those skilled in the art to refer to representations of these signals as bits, bytes, words, information, data, packets, nodes, numbers, points, entries, objects, images, files or the like. It should be kept in mind, however, that these and similar terms are associated with appropriate physical quantities for computer operations, and that these terms are merely conventional labels applied to physical quantities that exist within and during operation of the computer.

It should be understood that manipulations within the computer are often referred to in terms such as issuing, sending, altering, adding, disabling, determining, comparing, reporting, and the like, which are often associated with manual operations performed by a human operator. The operations described herein are machine operations performed in conjunction with various inputs provided by a human operator or user that interacts with the computer.

2. Hardware

It should be understood that the programs, processes, methods, etc. described herein are not related or limited to any particular computer or apparatus, nor are they related or limited to any particular communication architecture, other than as described. Rather, various types of general purpose machines, sensors, transmitters, receivers, transceivers, and network physical layers may be used with any program modules and any other aspects of the invention constructed in accordance with the teachings described herein. Similarly, it may prove advantageous to construct a specialized apparatus to perform the method steps described herein by way of dedicated computer systems in specific network architecture with hard-wired logic or programs stored in nonvolatile memory, such as read-only memory.

3. Program

In the preferred embodiment where any steps of the present invention are embodied in machine-executable instructions, the instructions can be used to cause a general-purpose or special-purpose processor which is programmed with the instructions to perform the steps of the present invention. Alternatively, the steps of the present invention might be performed by specific hardware components that contain hardwired logic for performing the steps, or by any combination of programmed computer components and custom hardware components.

The foregoing system may be conveniently implemented in a program or program module(s) that is based upon the diagrams and descriptions in this specification. No particular programming language has been required for carrying out the various procedures described above because it is considered that the operations, steps, and procedures described above and illustrated in the accompanying drawings are sufficiently disclosed to permit one of ordinary skill in the art to practice the present invention.

Moreover, there are many computers, computer languages, and operating systems which may be used in practicing the present invention and therefore no detailed computer program could be provided which would be applicable to all of these many different systems. Each user of a particular computer will be aware of the language and tools which are most useful for that user's needs and purposes.

The invention thus can be implemented by programmers of ordinary skill in the art without undue experimentation after understanding the description herein.

4. Components

The major components (also interchangeably called aspects, subsystems, modules, functions, services) of the system and method of the invention, and examples of advantages they provide, are described herein with reference to the figures. For figures including process/means blocks, each block, separately or in combination, is alternatively computer implemented, computer assisted, and/or human implemented. Computer implementation optionally includes one or more conventional general purpose computers having a processor, memory, storage, input devices, output devices and/or conventional networking devices, protocols, and/or conventional client-server hardware and software. Where any block or combination of blocks is computer implemented, it is done optionally by conventional means, whereby one skilled in the art of computer implementation could utilize conventional algorithms, components, and devices to implement the requirements and design of the invention provided herein. However, the invention also includes any new, unconventional implementation means.

5. Other Implementations

Other embodiments of the present invention and its individual components will become readily apparent to those skilled in the art from the foregoing detailed description. As will be realized, the invention is capable of other and different embodiments, and its several details are capable of modifications in various obvious respects, all without departing from the spirit and the scope of the present invention. Accordingly, the drawings and detailed description are to be regarded as illustrative in nature and not as restrictive. It is therefore not intended that the invention be limited except as indicated by the appended claims.

What is claimed is:

1. A system for custom fueling a motor vehicle to comply with the motor vehicle warranty comprising:

a. a fuel dispenser, the fuel dispenser blending petroleum-derived diesel and bio-diesel fuels from two or more tanks while dispensing;

b. a processor in communication with the fuel dispenser, the processor receiving a set of petroleum-derived diesel and bio-diesel fuel blend information and customer preferences for a motor vehicle;

c. a fuel blend selection module operably connected to the processor, the fuel blend selection module receiving the set of petroleum-derived diesel and bio-diesel fuel blend information and customer preferences, the fuel blend selection module identifying in-warranty bio-diesel blend ranges and customer fuel blend preferences in accordance with the set of petroleum-derived diesel and bio-diesel fuel blend information, the fuel blend selection module processing the set of fuel blend information and customer preferences, and the fuel blend selection module returning petroleum derived diesel and bio-diesel fuel blend instructions which are then provided to the fuel dispenser for dispensing petroleum-derived diesel and bio-diesel fuel per the fuel blend instructions.

2. The system of claim 1, further comprising an electronic calendar in communication with the processor, the electronic calendar providing the current date to the set of fuel blend information for use by the fuel blend selection module.

3. The system of claim 1, wherein the set of fuel blend information further comprises whether the vehicle engine is a full-time or part-time HCCl engine for use by the fuel blend selection module.

4. The system of claim 1, further comprising an ambient temperature-reading device in communication with the processor, the ambient temperature-reading device providing ambient temperature to the set of fuel blend information.

5. The system of claim 1, further comprising a wireless transceiver in communication with the processor, the wireless transceiver receiving the set of fuel blend information from the motor vehicle.

6. The system of claim 1, further comprising a USB port in communication with the processor, the USB port receiving the set of fuel blend information for the motor vehicle.

7. The system of claim 1, further comprising a data structure encoded in a non-transient medium operably connected to the processor, the data structure receiving customer identifying information provided by the customer and the data structure returning customer preferences to be added to the set of fuel blend information.

8. The system of claim 1 wherein the fuel blend selection module comprises at least one lookup table having fuel blend instructions associated with each unique set of fuel blend information, wherein upon receipt of the fuel blend information, the processor accesses the at least one lookup table for the associated fuel blend instructions which are then provided to the fuel dispenser for dispensing fuel per the fuel blend instructions.

9. The system of claim 1, further comprising at least one sensor in communication with the fuel blend selection module, the at least one sensor measuring the quality and composition of the available fuels for use by the fuel blend selection module.

10. The system of claim 9, where the at least one sensor comprises near infra-red sensors for estimating octane numbers for gasoline, for estimating cetane number for diesel, and for determining the nature of biodiesel by quantifying the oxygen content.

11. The system of claim 9, where the at least one sensor comprises inline vibratory cells for measuring density.

12. The system of claim 9, where the at least one sensor comprises micro-electro-mechanical systems-based microsensors, the micro-electro-mechanical systems-based microsensors measuring density and specific molecule concentration.

13. The system of claim 1, wherein the fuel dispenser blends fuels and additives for cleaning or preventing engine deposits or cleaning fuel injectors from two or more tanks while dispensing.

14. A method for custom fueling a motor vehicle to comply with the motor vehicle warranty comprising:

a. inputting a set of petroleum-derived diesel and bio-diesel fuel blend information for a motor vehicle sufficient to determine in-warranty bio-diesel blend ranges to a processor; wherein the processor is in communication with a fuel dispenser configured and adapted to blend petroleum-derived diesel and bio-diesel fuels from two or more tanks while dispensing, wherein the set of petroleum-derived diesel and biodiesel fuel blend information is sufficient to determine in-warranty biodiesel blend ranges, and wherein the processor is communication with a fuel blend selection module operably connected to the processor and configured and adapted for receiving the set of petroleum-derived diesel and bio-diesel fuel blend information, processing the set of petroleum-derived diesel and bio-diesel fuel blend information, and returning in-warranty petroleum-derived diesel and bio-diesel fuel blend instructions which are then provided to the fuel dispenser for dispensing petroleum-derived diesel and bio-diesel fuel per the fuel blend instructions;

b. passing the set of petroleum-derived diesel and bio-diesel fuel blend information to the fuel blend selection module, whereby fuel blend instructions are returned; and c. passing the petroleum-derived diesel and bio-diesel fuel blend instructions to the fuel dispenser for dispensing of petroleum-derived diesel and bio-diesel fuel according to the fuel blend instructions.

15. The method of claim 14, wherein the set of fuel blend information input via wireless transmitter/transceiver is sufficient to determine customer fuel blend preferences.

16. The method of claim 14, further comprising adding the current date to the fuel blend instructions for use by the fuel blend selection module.

17. The method of claim 14, further comprising adding whether the vehicle engine is a full-time or part-time HCCI engine to the set of fuel blend information for use by the fuel blend selection module.

18. The method of claim 14, further comprising adding the ambient temperature to the set of fuel blend information for use by the fuel blend selection module.

19. The method of claim 14, wherein the inputting step is via a wireless transceiver in communication with the processor.

20. The method of claim 14, wherein the inputting step is via a USB port in communication with the processor.

21. The method of claim 14, further comprising inputting customer identifying information provided by the customer to a data structure encoded in a non-transient medium, and operably connected to the processor and configured and adapted for receiving customer identifying information provided by the customer and returning customer preferences to be added to the set of fuel blend information.

22. The method of claim 14, further comprising passing the set of fuel blend information to at least one lookup table operably connected to the fuel blend selection module and having fuel blend instructions associated with each unique set of fuel blend information.

23. The method of claim 14, further comprising passing to the fuel blend selection module data from at least one sensor configured and adapted for measuring the quality and composition of the available fuels.

24. The method of claim 22, where the at least one sensor comprises near infra-red sensors for estimating octane numbers for gasoline, for estimating cetane number for diesel, and for determining the nature of biodiesel by quantifying the oxygen content.

25. The method of claim 22, where the at least one sensor comprises inline vibratory cells for measuring density.

26. The method of claim 22, where the at least one sensor comprises micro-electro-mechanical systems-based microsensors for measuring density and specific molecule concentration.

27. The method of claim 14, wherein the fuel dispenser is configured and adapted to blend fuels and non-fuel additives from two or more tanks while dispensing and the fuel blend instructions includes at least one additive.

* * * * *